US010601192B2

(12) United States Patent
Zhang et al.

(10) Patent No.: US 10,601,192 B2
(45) Date of Patent: Mar. 24, 2020

(54) THREE-DIMENSIONAL CONVERTOR

(71) Applicant: GONGNIU GROUP CO., LTD., Cixi Ningbo, Zhejiang (CN)

(72) Inventors: Jialu Zhang, Zhejiang (CN); Huijiu Wang, Zhejiang (CN); Lei Yan, Zhejiang (CN); Hao Deng, Zhejiang (CN)

(73) Assignee: GONGNIU GROUP CO., LTD. (JP)

( * ) Notice: Subject to any disclaimer, the term of this patent is extended or adjusted under 35 U.S.C. 154(b) by 0 days.

(21) Appl. No.: 16/064,985

(22) PCT Filed: Mar. 16, 2017

(86) PCT No.: PCT/CN2017/076997

§ 371 (c)(1),
(2) Date: Jun. 21, 2018

(87) PCT Pub. No.: WO2017/125095

PCT Pub. Date: Jul. 27, 2017

(65) Prior Publication Data

US 2018/0323558 A1 Nov. 8, 2018

(30) Foreign Application Priority Data

Jan. 18, 2016 (CN) ..... 2016 2 0043644 U

(51) Int. Cl.
*H01R 4/66* (2006.01)
*H01R 25/00* (2006.01)
(Continued)

(52) U.S. Cl.
CPC ..... *H01R 25/003* (2013.01); *H01R 13/506* (2013.01); *H01R 13/648* (2013.01);
(Continued)

(58) Field of Classification Search
CPC ..... H01R 13/652; H01R 31/02; H01R 31/00; H01R 25/003; H01R 31/06
(Continued)

(56) References Cited

U.S. PATENT DOCUMENTS 4,313,646 A * 2/1982 Millhimes ..... H01R 31/02 439/215
5,094,630 A * 3/1992 Jammet ..... H01R 31/02 439/652
(Continued)

FOREIGN PATENT DOCUMENTS

CN 201629446 U 11/2010
CN 203721952 U 7/2014
(Continued)

OTHER PUBLICATIONS

International Search Report for PCT/CN2017/076907. dated Jun. 20, 2017. 4 pages.
Chinese Patent Evaluation Report. dated Oct. 18, 2017. 4 pages.

*Primary Examiner* — Thanh Tam T Le
(74) *Attorney, Agent, or Firm* — Ostrolenk Faber LLP

(57) ABSTRACT

A three-dimensional convertor includes a housing and a socket interior arranged inside the housing. The socket interior includes clapboards, a live wire plug bush conductive sheet, a naught wire plug bush conductive sheet and an earth wire plug bush conductive sheet. The clapboards include a first clapboard, a second clapboard, a third clapboard and a fourth clapboard which are sequentially stacked. The naught wire plug bush conductive sheet is located between the first clapboard and the second clapboard, the earth wire plug bush conductive sheet is located between the second clapboard and the third clapboard, the live wire plug bush conductive sheet is located between the third clapboard and the fourth clapboard. The housing includes at least two jack surfaces each of which is provided with a jack. The jack
(Continued)

is corresponding to the live wire plug bush conductive sheet, the naught wire plug bush conductive sheet and the earth wire plug bush conductive sheet.

18 Claims, 8 Drawing Sheets

(51) Int. Cl.

| | |
|---|---|
| ***H01R 24/22*** | (2011.01) |
| ***H01R 31/02*** | (2006.01) |
| ***H01R 13/506*** | (2006.01) |
| ***H01R 13/648*** | (2006.01) |
| *H01R 13/514* | (2006.01) |
| *H01R 13/46* | (2006.01) |
| *H01R 13/447* | (2006.01) |
| *H01R 13/66* | (2006.01) |

(52) U.S. Cl.
CPC ..... *H01R 24/22* (2013.01); *H01R 31/02* (2013.01); *H01R 13/447* (2013.01); *H01R 13/46* (2013.01); *H01R 13/514* (2013.01); *H01R 13/665* (2013.01)

(58) Field of Classification Search
USPC ..... 439/106, 107, 652–654, 638
See application file for complete search history.

(56) References Cited

U.S. PATENT DOCUMENTS

| | | | | |
|---|---|---|---|---|
| 5,281,172 | A * | 1/1994 | Luu | H01R 31/02 439/651 |
| 5,383,799 | A * | 1/1995 | Fladung | H01R 25/006 439/108 |
| 6,015,303 | A * | 1/2000 | Bonilla | H01R 13/506 439/107 |
| 6,488,540 | B2 * | 12/2002 | Coyle, Jr. | H01R 25/003 439/650 |
| 6,929,514 | B1 * | 8/2005 | Chuang | H01R 31/02 439/108 |
| 7,892,036 | B2 * | 2/2011 | Lee | H01R 13/506 439/638 |
| 9,306,349 | B2 | 4/2016 | Si | |
| 2006/0216986 | A1 | 9/2006 | Amiri-Hezaveh | |

FOREIGN PATENT DOCUMENTS

| | | | |
|---|---|---|---|
| CN | 203787656 | U | 8/2014 |
| CN | 204304180 | U | 4/2015 |
| CN | 204349054 | U | 5/2015 |
| CN | 105207020 | A | 12/2015 |
| CN | 204966859 | U | 1/2016 |
| CN | 205355372 | U | 6/2016 |
| JP | 2015138691 | A | 7/2015 |

* cited by examiner

THREE-DIMENSIONAL CONVERTOR

CROSS REFERENCE TO RELATED APPLICATIONS

This application is a national phase entry under 35 USC 371 of International Patent Application No. PCT/CN20171/076997 filed on Mar. 16 2017, which claims priority to Chinese patent Application No. 201620043644.3 filed with the Chinese Patent Office on Jan. 18, 2016, entitled "THREE-DIMENSIONAL CONVERTOR", both of which are incorporated herein by reference in their entirety.

TECHNICAL FIELD

The present disclosure relates to the field of electrical equipment, and in particular, relates to a three-dimensional convertor.

BACKGROUND

A three-dimensional convertor is also called a magic cube socket. Generally, an individual conductive sheet is equipped to each jack on each side of the convertor, and then the jack and its corresponding conductive sheet are assembled to form a plug bush module on each side of the convertor. The plug bush modules are conducted among each other by means of welding flexible wires or other materials; however, this practice results in too many assembly parts and a complex manufacturing method. Moreover, as the conductive sheets with the same polar inside the plug bush module are welded together through wires and copper bars, a pseudo soldering or a false welding will be caused.

The Chinese application No. 201420868334.6 for utility model describes a three-dimensional multi-side socket unit and a combined socket. Said three-dimensional multi-side socket unit comprises a plug, an inner core assembly and a cubic outer box. The cubic outer box covers the outside of the inner core assembly. Said inner core assembly comprises a live wire integral elastic piece, an A cavity frame, an earth wire integral elastic piece, a B cavity frame, a naught wire integral elastic piece, and a side elastic piece terminal. Said earth wire integral elastic piece is clamped between the A cavity frame and the B cavity frame. The live wire integral elastic piece is installed on the A cavity frame, while the naught wire integral elastic piece is installed on the B cavity frame. The multi-side socket unit solves the problem of the pseudo soldering or the false welding resulted by welding the conductive sheets with the same polar inside the magic cube socket together through wires and copper bars. But, the assembly of the multi-side socket unit with the above structure is difficult when which is assembled, as the integral elastic pieces of the inner core assembly easily fall off from the corresponding cavity frames. Moreover, as the cubic outer box is divided into three parts, more steps of assembly will be involved.

SUMMARY

Therefore, the disclosure is intended to provide a three-dimensional convertor with less assembly steps, which is easy to be assembled.

The following technical solutions are provided: a three-dimensional convertor comprises a housing and a socket interior provided inside the housing; wherein, the socket interior comprises clapboards and a live plug bush conductive sheet, a naught wire plug bush conductive sheet and an earth plug bush conductive sheet; wherein, the clapboards comprise a first clapboard, a second clapboard, a third clapboard and a fourth clapboard which are sequentially stacked; the naught wire plug bush conductive sheet is provided between the first clapboard and the second clapboard, the earth plug bush conductive sheet is provided between the second clapboard and the third clapboard, and the live wire plug bush conductive sheet is provided between the third clapboard and the fourth clapboard; the housing comprises at least two jack surfaces on each of which jacks are provided, each jack corresponds to one of the live wire plug bush conductive sheet, the naught wire plug bush conductive sheet and the earth wire plug bush conductive sheet.

In some embodiments, the live plug bush conductive sheet, the naught wire plug bush conductive sheet and the earth plug bush conductive sheet are parallel to each other.

In some embodiments, a buckle structure is provided between the first clapboard and the fourth clapboard, to form a tight integral socket interior by mutually stacking each clapboard and each plug bush conductive sheet and making them press against each other.

In some embodiments, the buckle structure comprises buckle arms which can be buckled with each other and are provided between the first clapboard and the fourth clapboard, and each clapboard and its corresponding conductive sheet are pressed against each other when the buckle arm of the first clapboard is buckled with that of the fourth clapboard; and/or, the buckle structure comprises a first positioning post which is provided on the first clapboard or on the fourth clapboard and a first positioning hole which is provided on other clapboards except the one provided with the first positioning post and engages with the first positioning post.

In some embodiments, a clamping slot is provided on the free end of the buckle arm on the first clapboard, a clamping projection to buckle with the clamping slot is provided on the free end of the buckle arm on the fourth clapboard; or, a clamping slot is provided on the free end of the buckle arm on the fourth clapboard, a clamping projection to buckle with the clamping slot is provided on the free end of the buckle arm on the first clapboard.

In some embodiments, the buckle arms surround the peripheries of the second clapboard and the third clapboard; or, the buckle arms passes through the second clapboard and the third clapboard.

In some embodiments, a screwed hole to lock up with a screw is provided on the free end of the first positioning post, and a counter bore to accommodate the screw is provided on the clapboard where the free end of the first positioning post is located.

In some embodiments, a fixed bracket configured to lay up a circuit board is extended from a surface of the first clapboard far away from the second clapboard; or, a fixed bracket configured to lay up a circuit board is extended from a surface of the fourth clapboard far away from the third clapboard. The circuit board comprises a USB circuit board and/or a heavy-current switch circuit board.

In some embodiments, the fixed support comprises isolating tendons configured to insulate the heavy-current switch circuit board and the USB circuit board; and/or, an insulating board is provided on the first clapboard or the fourth clapboard installed with circuit boards, and the insulating board is configured to insulate the USB circuit board and the heavy-current switch circuit board.

In some embodiments, a threading hole configured to lead conductive cables out is provided on one side surface of the housing, and a wiring slot is recessed inward in a side surface of the socket interior that corresponds to the threading hole.

In some embodiments, a first wiring pin is provided on the live wire plug bush conductive sheet, a second wiring pin is provided on the naught wire plug bush conductive sheet, and the first wiring pin and the second wiring pin are both provided in the wiring slot.

In some embodiments, a first press block is provided on a side surface of the socket interior opposing the threading hole, a second press block is provided under the threading hole on the inner side of the housing, and the first press block and the second press block contact with each other when the socket interior is installed in the housing.

In some embodiments, when the first press block and the second press block contact with each other, a hole configured to let conductive wires pass through the threading hole is provided between the opposing faces of the first press block and the second press block.

In some embodiments, the earth wire plug bush conductive sheet is provided with the third wiring pin, and the third wiring pin is bent toward the earth wire plug bush conductive sheet, passing through the third clapboard and the fourth clapboard, and being exposed outside the fourth clapboard. Or, the third wiring pin passes through the first clapboard and the second clapboard and is exposed outside the first clapboard.

In some embodiments, a protective door module is provided between the socket interior and the inner side of the housing with the jack, and the protective door module is configured to protect the jack.

In some embodiments, a sticking post is provided on a side surface of the socket interior opposing the inner side of the housing, and the sticking post is configured to orientate the protective door module.

In some embodiments, a clamping joint is provided on a side of the isolating tendon facing towards the upper cover, the clamping joint extends towards the upper cover, and a blind groove that engages with the clamping joint is provided on a corresponding inner surface of the upper housing lid.

In some embodiments, a positioning mechanism is provided between each clapboard and each corresponding conductive sheet which are stacked alternatively, and the positioning mechanism is configured to orientate each conductive sheet to each corresponding clapboard.

In some embodiments, the positioning mechanism comprises a second positioning post provided on the clapboard, and a second positioning hole respectively provided on the live wire plug bush conductive sheet, the naught wire plug bush conductive sheet and the earth wire plug bush conductive sheet, second positioning holes are one to one corresponding to and engage with second positioning posts.

Yet, another three-dimensional convertor is provided. The three-dimensional convertor comprises: a housing; and a socket interior provided inside the housing; wherein, the socket interior comprises clapboards comprising a first clapboard, a second clapboard, a third clapboard and a fourth clapboard which are sequentially stacked, and a live plug bush conductive sheet, a naught wire plug bush conductive sheet and an earth plug bush conductive sheet; wherein, the live wire plug bush conductive sheet is provided between the first clapboard and the second clapboard, the earth plug bush conductive sheet is provided between the second clapboard and the third clapboard, and the naught wire plug bush conductive sheet is provided between the third clapboard and the fourth clapboard; the housing comprises at least two jack surfaces on each of which a jack is provided, each jack corresponds to one of the live wire plug bush conductive sheet, the naught wire plug bush conductive sheet and the earth wire plug bush conductive sheet.

The advantages of the present disclosure over the prior art lie in that, as each of the plug bush conductive sheets in the present disclosure is clamped between two corresponding clapboards, and when the 3 dimensional convertor is assembled, it is only required that to make each plug bush conductive sheet and each clapboard to be alternatively stacked and compressed tightly, and then to form an integral socket interior by locking up the buckle structure between the first clapboard and the fourth clapboard, and finally to complete the assembly by put the socket interior into the housing. The difficulty of assembly is reduced and the efficiency of assembly is improved. Moreover, some wiring slots and press blocks are provided on the clapboards, so as to make it easier to route wires after the wires has been weld to wiring pins of each plug bush conductive sheet. And the arrangement that the threading hole in the housing being directly opposed to the press block reduces the length of the wires, increases the utilization rate of the inner space of the 3D convertor and meanwhile relatively reduces the overall dimension of the 3D convertor.

11 first clapboard;
111 buckle arm;
1111 clamping slot;
112 isolating tendon;
1121 clamping joint;
12 second clapboard;
13 third clapboard;
14 fourth clapboard;
141 clamping projection;
142 first press block;
143 sticking post;
21 live wire plug bush conductive sheet;
211 first wiring pin;
22 naught wire plug bush conductive sheet;
221 second wiring pin;
23 earth wire plug bush conductive sheet;
231 third wiring pin;
31 first positioning post;
311 screwed hole;
32 first positioning hole;
33 counter bore;
34 screw;
4 wiring slot;

5 lead wire limit slot;
61 USB circuit board;
62 heavy-current switch circuit board;
63 insulation board;
7 protective door module;
81 lower housing;
811 bearing surface;
812 jack surface;
813 threading surface;
8131 second press block;
8132 threading hole;
82 upper cover;
91 second positioning post;
92 second positioning hole.

DETAILED DESCRIPTION

The disclosure will be described in detail below through examples in combination of the drawings. The following examples are only exemplary and do not limit the protection scope of the present disclosure.

EXAMPLE 1

Figure 1:
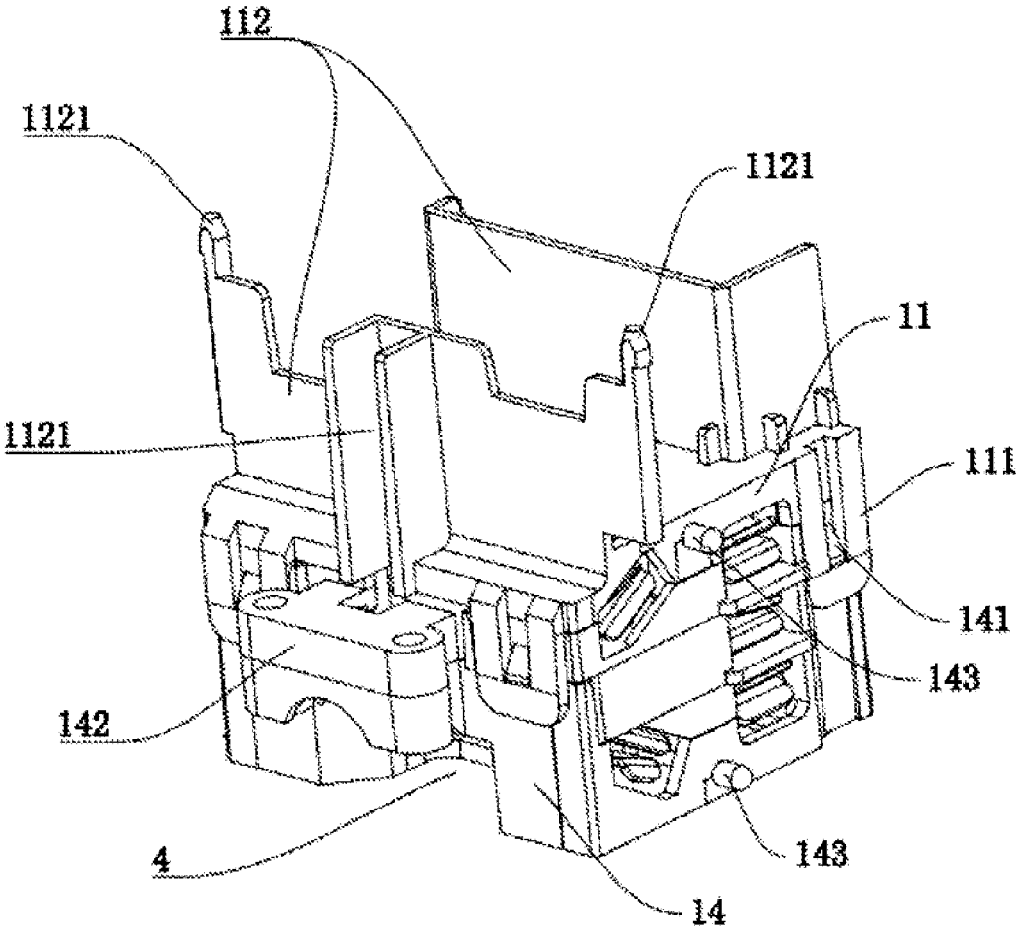
FIG. 1 illustrates the assembly view of a socket interior of example 1.
Figure 2:
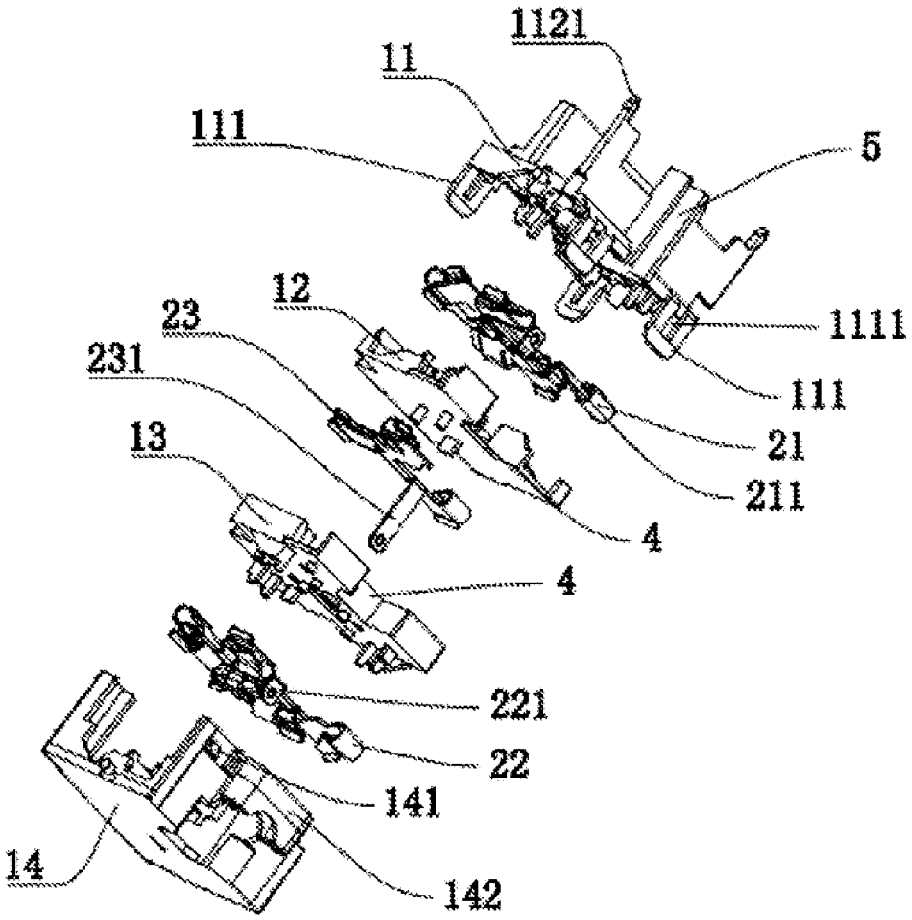
FIG. 2 illustrates the exploded view of the socket interior of example 1.

Please refer to FIG. 1 and FIG. 2, a 3D convertor comprises a socket interior within a housing. The socket interior comprises clapboards and plug bush conductive sheets. The clapboards include a first clapboard 11, a second clapboard 12, a third clapboard 13 and a fourth clapboard 14 which are sequentially stacked. While the plug bush conductive sheets comprise a live wire plug bush conductive sheet 21 arranged between the first clapboard 11 and the second clapboard 12, an earth wire plug bush conductive sheet 23 arranged between the second clapboard 12 and the third clapboard 13, and a naught wire plug bush conductive sheet 22 arranged between the third clapboard 13 and the fourth clapboard 14. It should be understood that, in some embodiments of the disclosure the naught wire plug bush conductive sheet 22 is provided between the first clapboard 11 and the second clapboard 12, the earth plug bush conductive sheet 23 is provided between the second clapboard 12 and the third clapboard 13, and the live wire plug bush conductive sheet 21 is provided between the third clapboard 13 and the fourth clapboard 14. The positions where each plug bush conductive sheet is located is not limited by the disclosure, as long as the positions of each plug bush conductive sheet satisfy the positive order or the reverse order of "live", "earth" and "naught". And the positions where each clapboard is located is not limited by the disclosure, as long as the positions of each clapboard satisfy the positive order or the reverse order of "first", "second", "third" and "fourth".

The live plug bush conductive sheet 21, the naught wire plug bush conductive sheet 22 and the earth plug bush conductive sheet 23 are parallel to each other, so that the structure of the 3D convertor is very simple, comparing with a structure that live plug bush conductive sheet, the naught wire plug bush conductive sheet and the earth plug bush conductive sheet are crossed with each other.

A buckle structure is provided between the first clapboard 11 and the fourth clapboard 14 which are at the opposite ends, to form a tight integral socket interior by mutually stacking each clapboard and each plug bush conductive sheet and making them press against each other. The buckle structure may comprise a buckle arm 111 provided at the edge of the first clapboard 11 and extending towards the fourth clapboard 14, with a clamping slot 1111 provided on the buckle arm 111, and a clamping projection 141 that engages with the clamping slot 1111 of the buckle arm 111 provided on the fourth clapboard 14. It can be understood that the buckle arm could also be provided on the fourth clapboard 14, while the clamping projection 141 could be provided on the first clapboard 11. And in example 1, in order to make the buckling of the buckle structure more stable, three buckle arms are provided on the fourth clapboard 14 but not in a straight line. The buckle arms respectively surrounds the peripheries of the second clapboard 12 and the third clapboard 13 after the socket interior is assembled; of course, it can be understood that the buckle arms may also buckle with the clamping projection 141 of the fourth clapboard 14 after respectively passing through the second clapboard 12 and the third clapboard 13.

Figure 7:
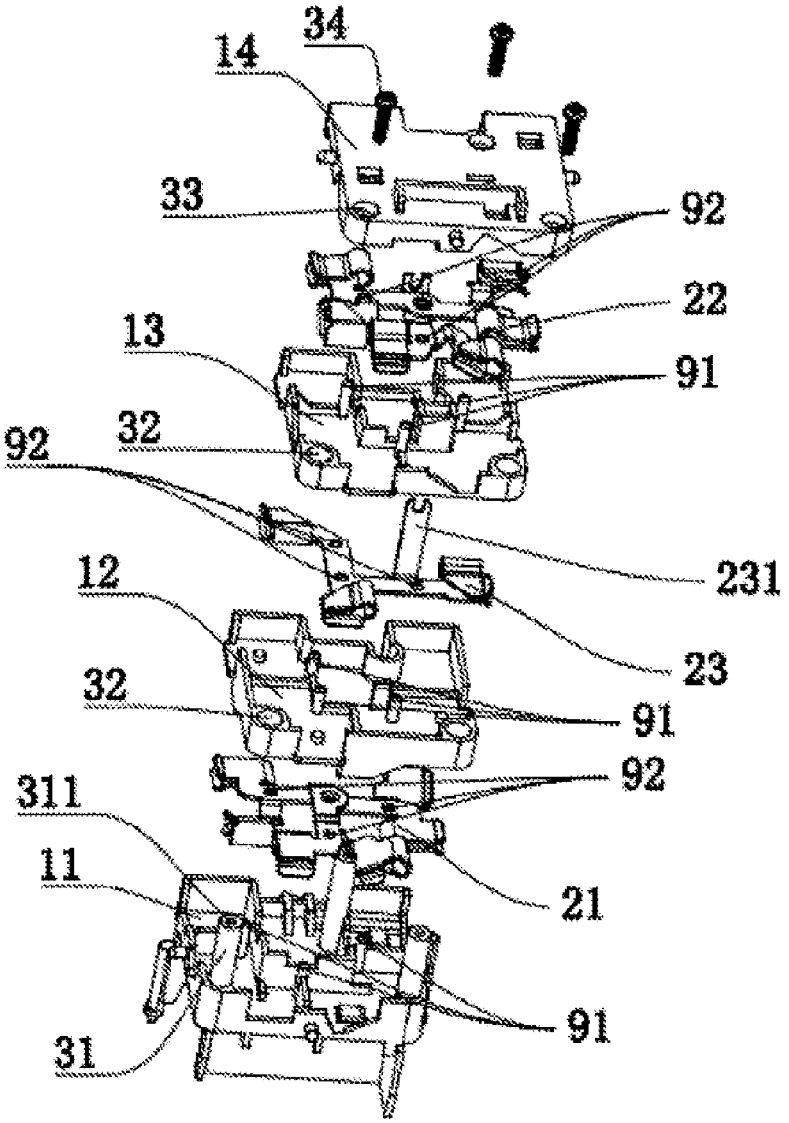
FIG. 7 is the exploded view of a socket interior of example 3.

When installing the plug bush conductive sheets, in order to orientate the installation position between each conductive sheet and each corresponding clapboard more accurately, positioning mechanisms are provided between each conductive sheet and each corresponding clapboard, referring to the visual angle of the clapboards and the conductive sheets in FIG. 7. The positioning mechanism comprises second positioning posts 91 provided on a surface of the first clapboard 11 facing towards the live wire plug bush conductive sheet 21, on a surface of the second clapboard 12 facing towards the earth wire plug bush conductive sheet 23, and on a surface of the third clapboard 13 facing towards the naught wire plug bush conductive sheet 22; and second positioning holes 92 provided on the live wire plug bush conductive sheet 21, on the earth wire plug bush conductive sheet 23 and on the naught wire plug bush conductive sheet 22 which engage with the second positioning posts 91. The number of the second positioning posts 91 on each clapboard is at least two, so that the conductive sheets can be accurately installed on each clapboard. Of course, it can be understood that the second positioning posts 91 could also be provided on a surface of the fourth clapboard 14 facing towards the naught wire plug bush conductive sheet 22, on a surface of the third clapboard 13 facing towards the earth wire plug bush conductive sheet 23, and on a surface of the second clapboard 12 facing towards the live wire plug bush conductive sheet 21, or simultaneously provided on the opposite two surfaces of corresponding clapboards.

In order to improve the space utilization of the socket interior and the distribution reasonability of conductive wires inside the socket interior, each of the side surfaces of the second clapboard 12, the third clapboard 13 and the fourth clapboard 14 which are in the same orientation is recessed inward to form a wiring slot 4. And on the side surface of the fourth clapboard 14 there is also provided a first press block 142 spaning across the wiring slot 4. Referring to FIG. 2, a first wiring pin 211 is provided on the live wire plug bush conductive sheet 21, and a second wiring pin 221 is provided on the naught wire plug bush conductive sheet 22. In the assembled socket interior, the first wiring pin 211 and the second wiring pin 221 are located within the wiring slots 4, leading to the convenience placement of conductive wires such as wiring pins; and a third wiring pin 231 is provided on the earth wire plug bush conductive sheet 23, and the third wiring pin 231 is bent against the earth wire plug bush conductive sheet 23, and the third wiring pin 231 passes through the third clapboard 13 and the fourth clapboard 14 and exposed outside the fourth clapboard 14 after the socket interior is assembled.

Figure 3:
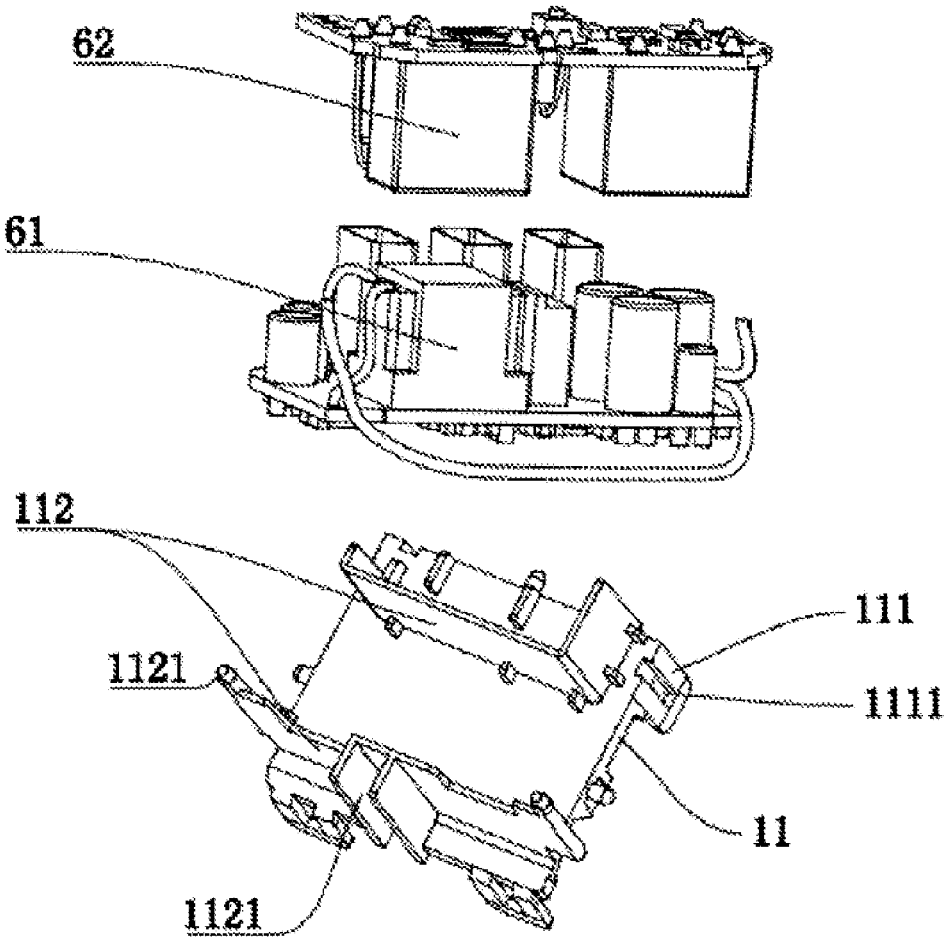
FIG. 3 illustrates the exploded view of a first clapboard and a circuit board of example 1.

As shown in FIG. 3, in order to enhance the function of the socket interior, the socket interior is also provided with a USB circuit board 61 and a heavy-current switch circuit board 62. In example 1, a fixed bracket is extended from a surface of the first clapboard 11 far away from the second clapboard 12 and is configured to lay up the above circuit boards; or a fixed bracket is extended from a surface of the fourth clapboard 14 far away from the third clapboard 13 and is configured to lay up the above circuit boards. On the surface of the first clapboard 11 far away from the second clapboard 12 is provided with the USB circuit board 61 and the heavy-current switch circuit board 62, and on this surface of the first clapboard 11 is also provided with isolating tendons 112 configured to insulate the heavy-current switch circuit board 62 and the USB circuit board 61; of course, it can be understood that when the USB circuit board 61 and the heavy-current switch circuit board 62 are provided on the surface of the fourth clapboard 14 far away from the third clapboard 13, then the isolating tendons 112 are also correspondingly provided on this surface of the fourth clapboard 14, and meanwhile, the wiring slots 4 are provided on the first clapboard 11, the second clapboard 12 and the third clapboard 13, while the first press block 142 is provided at the position on the first clapboard 11 where it snaps across the wiring slot 4. And in order to make it easier to route the wires, a lead wire limit slot 5 is also provided on the isolating tendons 112 that corresponds to the press block 142.

Figure 4:
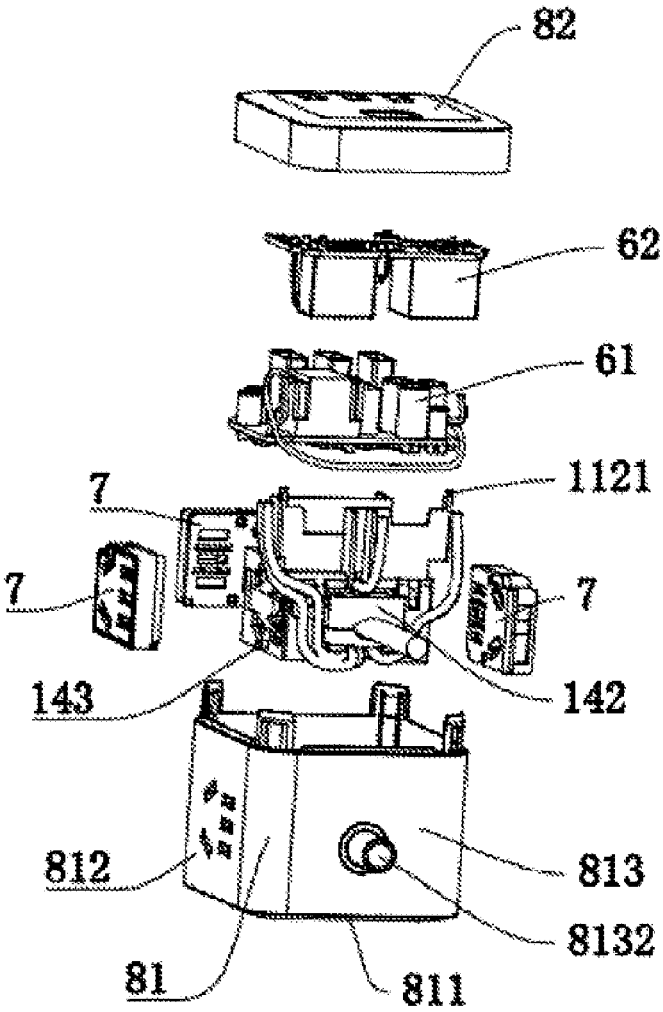
FIG. 4 illustrates the exploded view of a housing and the socket interior of example 1.
Figure 5:
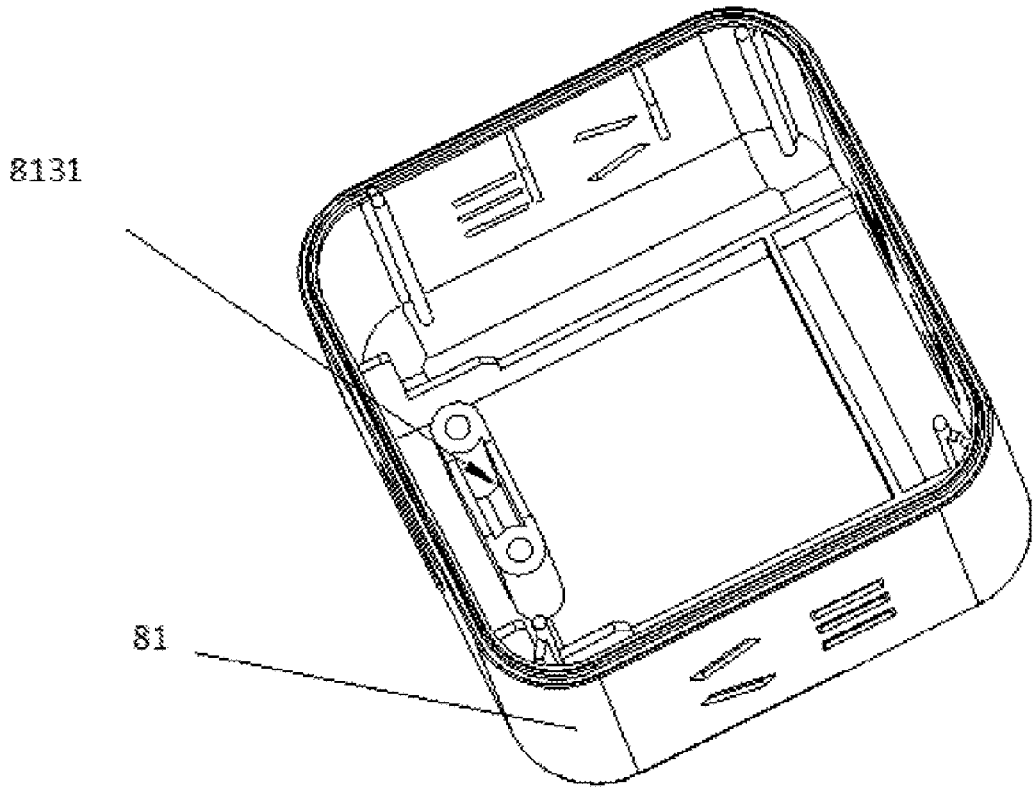
FIG. 5 is the axonometric view of a lower housing in example 1.

FIG. 4 is the exploded view of the housing and the socket interior of the 3D convertor. The housing comprises a lower housing 81 with an opening and an upper cover 82 that can close the opening. In order to make it easier to install the upper cover 82, let the upper cover 82 correspond to the USB circuit board 61 and the heavy-current switch circuit board 62 of the socket interior, and the upper cover 82 is provided with a USB structure and a switch that turns on/off the 3D convertor. The bottom surface of the lower housing 81 opposing the upper cover 82 is a bearing surface 811. Considering the function of the bearing surface 811, and in order to reduce the volume of the 3D convertor, no jacks are provided on the bearing surface 811. One side surface of the lower housing 81 is provided with a threading hole and defined as a threading surface, and the threading hole 8132 corresponds to the first press block 142, so as to make it easier to lead the wires out from the rocket interior. As shown in FIG. 5, on the inner side of the treading surface 813 of the lower housing 81 there is also provided with a second press block 8131. The second press block 8131 forms as a group with the first press block 142 provided on the clapboard. And between the first press block 142 and the second press block 8131 are formed holes for passing conductive cables, and via this arrangement the quantity of wires inside the socket interior is reduced and the volume of the 3D convertor is also reduced. Other side surfaces of the lower housing 81 are provided with jacks and defined as jack surfaces 812. In order to improve the safety when using the 3D convertor, a protective door module 7 is provided between the socket interior and the jack surface 812, and to make it easier to install the protective door module 7, a sticking post 143 is provided on the side surface of the socket interior. Firstly, the sticking post 143 is used to install the socket interior and the protective door module 7, and then the socket interior installed with the protective door module 7 is placed into the lower housing 81 as a whole, to make the threading surface 813 of the lower housing 81 to correspond to the press block 142 of the socket interior, and successively the upper cover 82 is covered to make a clamping joint 1121 of the socket interior directly plug into a blind hole slot (not shown in the figures) in the inner side of the upper cover 82, and thereby a convenient installation has been completed. It can be understood that, in example 1, said housing may be of other forms. For example, the housing could comprise a middle body with two openings each at its two opposite ends and two end caps each covering one of the two openings of the middle body, that is, the lower housing 81 in FIG. 4 is divided into two parts, and for this no further elaboration is needed here.

EXAMPLE 2

Figure 6:
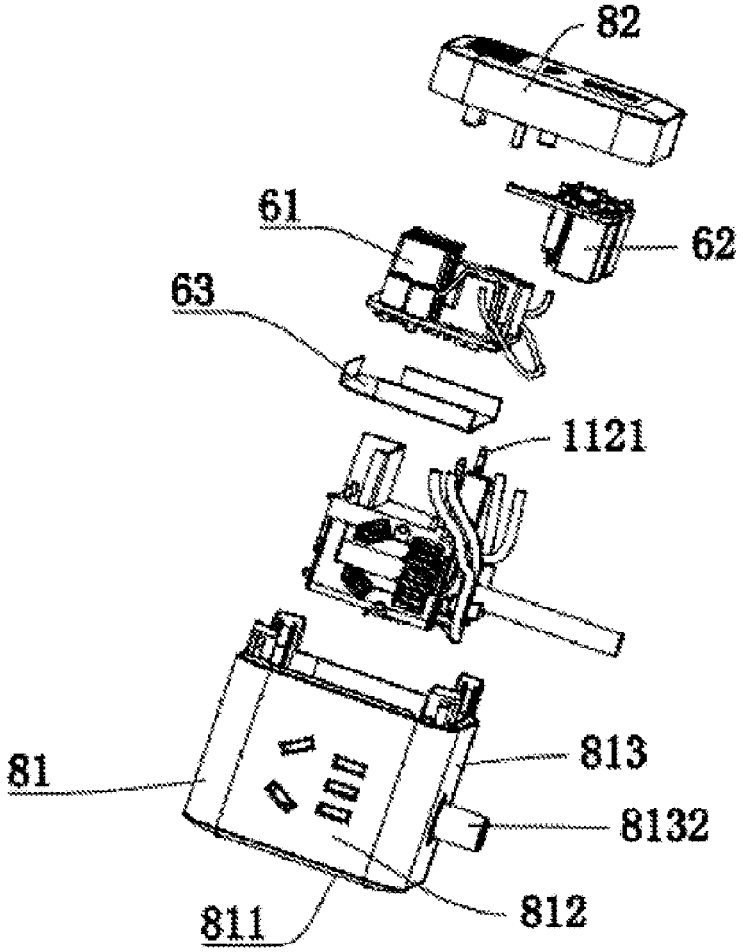
FIG. 6 is the exploded view of a housing and a socket interior of example 2.

FIG. 6 is an exploded view of a housing and a socket interior of a 3D convertor. This 3D convertor differs from that of example 1 in that an insulation board 63 is provided between the first clapboard 11 and the circuit boards, that is, the socket interior is provided with an insulation board 63 that insulates the USB circuit board 61 and the heavy-current switch circuit board 62 from the first clapboard 11. The insulation board 63 is configured to increase the electric clearance between the circuit boards and the live wire plug bush conductive sheet 21 or the electric clearance between the circuit boards and the naught wire plug bush conductive sheet 22 to make it comply with the regulations of relevant standards.

EXAMPLE 3

FIG. 7 is the exploded view of the socket interior. The socket interior differs from that of example 1 in that the buckle structure between the fourth clapboard 14 and the first clapboard 11 is removed, instead, a positioning post 31 is provided on the surface of the first clapboard 11 opposing the second clapboard 12, and a positioning hole 32 which engages with the positioning post 31 is provided on the second clapboard 12 and the third clapboard 13, respectively. A screwed hole 311 which can be locked with a screw is provided on an end surface of the positioning post 31. And a counter bore 33 is provided on the fourth clapboard 14 that corresponds to the screwed hole 311. It can be understood that the positioning post 31 may also be provided on the surface of the fourth clapboard 14 opposing the third clapboard 13 (not shown in the figures), and the positioning hole 32 that engages with the positioning post 31 is provided on the second clapboard 12 and the third clapboard 13, respectively. The screwed hole 311 which can be locked with the screw 34 is provided on an end surface of the positioning post 31, and the counter bore 33 that corresponds to the screwed hole 311 is provided on the first clapboard 11. When assembling the socket interior, the positioning post 31 on the first clapboard 11 is allowed to pass through the positioning holes 32 of the second clapboard 12 and the third clapboard 13 in sequence, and then to abut with the counter bore 33 on the fourth clapboard 14. As the end surface of the positioning post 31 is provided with the screwed hole 311, the screw 34 can be used to lock into the screwed hole 311, and thereby the fixation and installation of the socket interior are realized.

EXAMPLE 4

Figure 8:
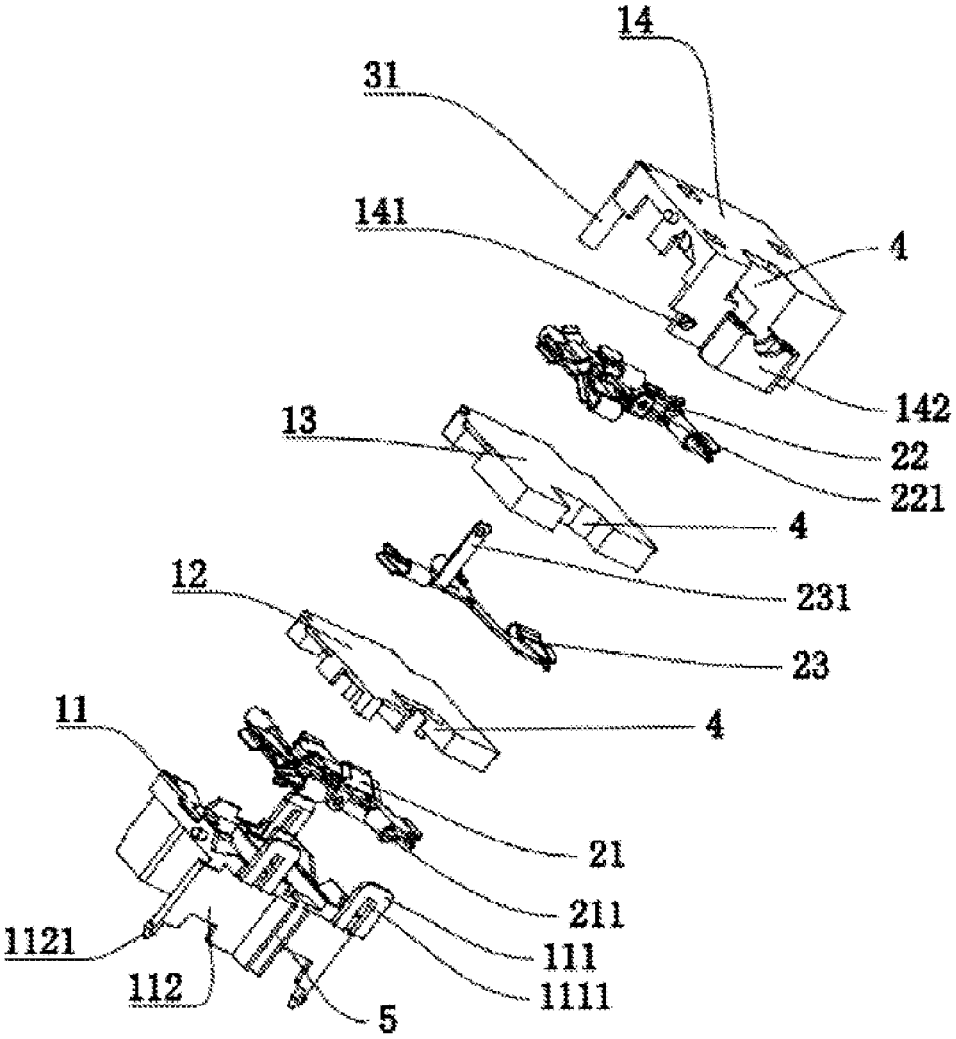
FIG. 8 is the exploded view of a socket interior of example 4.

FIG. 8 is the exploded view of the socket interior, which differs from example 1 also in the socket interior. In reference to example 1 and example 3, example 4 uses not only the buckle structure but also the structure of the positioning post 31. The buckle arms 111 are provided at the edge of the first clapboard 11 and extend towards the fourth clapboard 14. And the buckle arm is provided at each of three corners of the first clapboard 11 and the counter bore 33 is provided at the last corner of the first clapboard 11. The clamping slot 1111 is provided on each of the buckle arms 111, while the clamping projection 141 that snaps with the clamping slot 1111 of the buckle arm 111 is provided at each of the corresponding three corners of the fourth clapboard 14, and the positioning post 31 that corresponds to the counter bore 33 is provided at the last corner of the fourth clapboard 14. It can be understood that the number of the buckle arm 111 could be one or two, while the number of the positioning post 31 could be two or three. During installation, each clapboard is superposed over one another, and the screw 34 is locked into the screwed hole 311 of the positioning post 31 after the positioning post 31 corresponds to the counter bore 33, while the clamping slot 1111 of the buckle arm 111 snaps with the clamping projection 141, thereby the assembly of the socket interior is finished. It is can be seen that, between each clapboard and its corresponding conductive sheet, no positioning mechanism is provided here. It can be understood that, according to the actual practice, a positioning mechanism as disclosed in example 1 can be provided between each clapboard and its corresponding conductive sheet.

The above are only the preferred examples of the present disclosure. The protection scope of the present disclosure is not limited to the above examples. Any technical solution under the concept of the present disclosure falls within the protection scope of the present disclosure. It should be pointed out that all improvements without deviating from the principles of the present disclosure should be deemed as falling within the protection scope of the disclosure.

What is claimed is:

1. A three-dimensional convertor, comprising:

a housing; and, a socket interior provided inside the housing; wherein the socket interior comprises:

clapboards comprising a first clapboard, a second clapboard, a third clapboard and a fourth clapboard which are sequentially stacked; and, a live plug bush conductive sheet, a naught wire plug bush conductive sheet and an earth plug bush conductive sheet; wherein, the naught wire plug bush conductive sheet is provided between the first clapboard and the second clapboard, the earth plug bush conductive sheet is provided between the second clapboard and the third clapboard, and the live wire plug bush conductive sheet is provided between the third clapboard and the fourth clapboard;

a buckle structure provided between the first clapboard and the fourth clapboard, so as to form a tight integral socket interior by mutually stacking each clapboard and each plug bush conductive sheet and making them press against each other;

wherein the buckle structure comprises at least one of:

(1) buckle arms buckled with each other and positioned between the first clapboard and the fourth clapboard, and each clapboard and a corresponding conductive sheet are pressed against each other when a buckle arm of the first clapboard is buckled with a buckle arm of the fourth clapboard; or (2) a first positioning post positioned on the first clapboard or on the fourth clapboard, and a first positioning hole positioned on other clapboards except on the clapboard provided with the first positioning post and engages with the first positioning post; and the housing comprises at least two jack surfaces and a jack is provided on each of the at least two jack surfaces, wherein each jack corresponds to one of the live wire plug bush conductive sheet, the naught wire plug bush conductive sheet and the earth wire plug bush conductive sheet.

2. The three-dimensional convertor according to claim 1, wherein a clamping slot is positioned on at least one of:

(1) a free end of the buckle arm on the first clapboard, and a clamping projection to buckle with the clamping slot is provided on a free end of the buckle arm on the fourth clapboard; or, (2) the free end of the buckle arm on the fourth clapboard, and a clamping projection to buckle with the clamping slot is provided on the free end of the buckle arm on the first clapboard.

3. The three-dimensional convertor according to claim 1, wherein the buckle arms at least one of:

(1) surround the peripheries of the second clapboard and the third clapboard; or (2) pass through the second clapboard and the third clapboard.

4. The three-dimensional convertor according to claim 3, wherein a screwed hole to lock up with a screw is provided on the free end of the first positioning post, and a counter bore to accommodate the screw is provided on a clapboard where the free end of the first positioning post is located.

5. The three-dimensional convertor according to claim 1, wherein a fixed bracket configured to lay up a circuit board is extended from at least one of:

(1) a surface of the first clapboard far away from the second clapboard; or (2) a surface of the fourth clapboard far away from the third clapboard.

6. The three-dimensional convertor according to claim 5, wherein the circuit board comprises a USB circuit board and/or a heavy-current switch circuit board;

the fixed support comprises at least one of:

(1) isolating tendons configured to insulate the heavy-current switch circuit board and the USB circuit board; or, (2) an insulating board positioned on the first clapboard or the fourth clapboard installed with circuit boards, and the insulating board is configured to insulate the USB circuit board and the heavy-current switch circuit board.

7. The three-dimensional convertor according to claim 6, wherein, a clamping joint is provided on a side of the isolating tendon facing towards the upper cover, the clamping joint extends towards the upper cover, and a blind groove that engages with the clamping joint is provided on a corresponding inner surface of the upper housing lid.

8. The three-dimensional convertor according to claim 1, wherein, a threading hole configured to lead conductive cables out is provided on one side surface of the housing, and a wiring slot is recessed inward in a side surface of the socket interior that corresponds to the threading hole.

9. The three-dimensional convertor according to claim 8, wherein, a first wiring pin is provided on the live wire plug bush conductive sheet, a second wiring pin is provided on the naught wire plug bush conductive sheet, and the first wiring pin and the second wiring pin are both provided in the wiring slot.

10. The three-dimensional convertor according to claim 9, wherein, a first press block is provided on a side surface of the socket interior opposing the threading hole, a second press block is provided under the threading hole on the inner side of the housing, and the first press block and the second press block contact with each other when the socket interior is installed in the housing.

11. The three-dimensional convertor according to claim 10, wherein, when the first press block and the second press block contact with each other, a hole configured to let conductive wires pass through the threading hole is provided between the opposing faces of the first press block and the second press block.

12. The three-dimensional convertor according to claim 1, wherein a third wiring pin is provided on the earth wire plug bush conductive sheet and is bent and extends towards at least one of:

(1) the fourth clapboard, and the third wiring pin penetrates the fourth clapboard; or (2) the first clapboard, and the third wiring pin penetrates the first clapboard.

13. The three-dimensional convertor according to claim 1, wherein, a protective door module is provided between the socket interior and the inner side of the housing with the jack, and the protective door module is configured to protect the jack.

14. The three-dimensional convertor according to claim 13, wherein, a sticking post is provided on a side surface of the socket interior opposing the inner side of the housing, and the sticking post is configured to orientate the protective door module.

15. The three-dimensional convertor according to claim 1, wherein, a positioning mechanism is provided between each clapboard and each corresponding conductive sheet which are stacked alternatively, and the positioning mechanism is configured to orientate each conductive sheet to each corresponding clapboard.

16. The three-dimensional convertor according to claim 15, wherein, the positioning mechanism comprises a second positioning post provided on each clapboard, and a second positioning hole respectively provided on the live wire plug bush conductive sheet, the naught wire plug bush conductive sheet and the earth wire plug bush conductive sheet, second positioning holes are one to one corresponding to and engage with second positioning posts.

17. The three-dimensional convertor according to claim 1, wherein, the live plug bush conductive sheet, the naught wire plug bush conductive sheet and the earth plug bush conductive sheet are parallel to each other.

18. A three-dimensional convertor, comprising:

a housing; and a socket interior provided inside the housing;

wherein the socket interior comprises:

clapboards comprising a first clapboard, a second clapboard, a third clapboard and a fourth clapboard which are sequentially stacked; and, a live plug bush conductive sheet, a naught wire plug bush conductive sheet and an earth plug bush conductive sheet;

wherein the live wire plug bush conductive sheet is provided between the first clapboard and the second clapboard, the earth plug bush conductive sheet is provided between the second clapboard and the third clapboard, and the naught wire plug bush conductive sheet is provided between the third clapboard and the fourth clapboard;

a buckle structure provided between the first clapboard and the fourth clapboard, so as to form a tight integral socket interior by mutually stacking each clapboard and each plug bush conductive sheet and making them press against each other;

wherein the buckle structure comprises at least one of:

(1) buckle arms buckled with each other and positioned between the first clapboard and the fourth clapboard, and each clapboard and a corresponding conductive sheet are pressed against each other when a buckle arm of the first clapboard is buckled with a buckle arm of the fourth clapboard; or (2) a first positioning post positioned on the first clapboard or on the fourth clapboard, and a first positioning hole provided on other clapboards except on the clapboard provided with the first positioning post and engages with the first positioning post; and the housing comprises at least two jack surfaces and a jack is provided on each of the at least two jack surfaces, wherein each jack corresponds to one of the live wire plug bush conductive sheet, the naught wire plug bush conductive sheet and the earth wire plug bush conductive sheet.

* * * * *